US005665048A

United States Patent [19]

Jorgensen

[11] Patent Number: 5,665,048

[45] Date of Patent: Sep. 9, 1997

[54] CIRCUMFERENTIALLY DRIVEN CONTINUOUS FLOW CENTRIFUGE

[76] Inventor: Glen Jorgensen, 28 Beverly Dr., Marlboro, Mass. 01752

[21] Appl. No.: 577,830

[22] Filed: Dec. 22, 1995

[51] Int. Cl.[6] ..... B04B 9/00

[52] U.S. Cl. ..... 494/18; 494/84

[58] Field of Search ..... 494/12, 17, 18, 494/21, 45, 83, 84; 210/380.1, 380.3, 781, 782

[56] References Cited

U.S. PATENT DOCUMENTS

| | | | |
|---|---|---|---|
| 4,163,519 | 8/1979 | Stabile | 494/18 |
| 4,216,770 | 8/1980 | Cullis et al. . | |
| 4,221,322 | 9/1980 | Drago et al. | 494/18 X |
| 4,230,263 | 10/1980 | Westberg | 494/45 |
| 4,389,206 | 6/1983 | Bacehowski et al. . | |
| 4,419,089 | 12/1983 | Kolobow et al. . | |
| 4,425,112 | 1/1984 | Ito | 494/18 |
| 4,710,161 | 12/1987 | Takabayashi et al. | 494/18 X |
| 4,950,401 | 8/1990 | Unger et al. | 494/18 X |

*Primary Examiner*—Charles E. Cooley

[57] ABSTRACT

A centrifuge for rotating a fluid retentive housing having fluid input and output tubing fixedly connected to a rotation axis of the fluid retentive housing, the centrifuge comprising: a frame; a first rotatable mechanism having a rotation axis, the fluid retentive housing being coaxially mounted thereon for co-rotation therewith; a second rotatable mechanism having a rotation axis, the first and second rotation mechanism being coaxially mounted on the frame; the second rotatable mechanism having an outer circumferential surface engaged with a drive mechanism, the drive mechanism driving the outer circumferential surface such that the second rotatable mechanism rotates at a selected rotational speed X; the first rotatable mechanism being interconnected to the second rotatable mechanism such that the first rotatable mechanism rotates simultaneously with the second rotatable mechanism at a rotational speed of 2X.

20 Claims, 8 Drawing Sheets

CIRCUMFERENTIALLY DRIVEN CONTINUOUS FLOW CENTRIFUGE

BACKGROUND

The present invention relates to centrifuge apparati and more particularly to a centrifuge which works in conjunction with a cassette, rotor or other device having fluid retentive chambers and fluid flow tubing fixedly attached to the axis of the device. In the context of mechanisms which have come to be known as continuous flow centrifuges, when a length of tubing is fixedly attached to the rotation axis of a device which contains the fluid material to be centrifuged, the entire length of tubing must be rotated by use of rotary seals or some other means to avoid twisting the tubing. A well known method for avoiding the use of rotary seals is to curve the length of tubing outwardly from the axis and around the outer edge of the circumference of the rotor, cassettes or the like and, to rotate the tubing in an orbital fashion around the rotor/cassette at one-half times the rotational speed of the rotor/cassette itself. Such a method for eliminating tube twisting and apparati therefor are disclosed, for example, in U.S. Pat. Nos. 4,216,770, 4,419,089 and 4,389,206.

Problems inherent in such prior apparatuses which orbit the fluid flow tubing around the axis of centrifuge rotation are that the axis of rotation is disposed vertically, the tubing is routed through an axial shaft and the apparatus is driven by driving an axial shaft which requires a high aspect ratio and an elongated shaft which limit the rotational speed, render the apparatus instable and limits the ability of the user to mount a second cassette, rotor or the like on opposing sides of the chuck component of the apparatus.

SUMMARY OF THE INVENTION

Therefore, in accordance with the invention there is provided a centrifuge for rotating a fluid retentive housing having fluid input and output tubing fixedly connected to a rotation axis of the fluid retentive housing, the centrifuge comprising: a frame; a first rotatable mechanism having a rotation axis, the fluid retentive housing being coaxially mounted thereon for co-rotation therewith; a second rotatable mechanism having a rotation axis, the first and second rotation mechanism being coaxially mounted on the frame; the second rotatable mechanism having an outer circumferential surface engaged with a drive mechanism, the drive mechanism driving the outer circumferential surface such that the second rotatable mechanism rotates at a selected rotational speed X; the first rotatable mechanism being interconnected to the second rotatable mechanism such that the first rotatable mechanism rotates simultaneously with the second rotatable mechanism at a rotational speed of 2X.

The second rotatable mechanism includes a seat for holding a distal length of the output tubing which extends from the axis of the fluid retentive housing, wherein the distal length of the output tubing held by the seat is rotated around the rotation axis at the same rotational speed as the second rotatable mechanism. Preferably, the first and second rotatable mechanisms are mounted such that their axes of rotation are disposed horizontally. Most preferably, the first rotatable mechanism has opposing mounting faces for mounting a fluid retentive housing on each of the opposing mounting faces. The outer circumferential surface which engages the drive mechanism is spaced a selected radial distance from the rotation axis, the seat being mounted on the second rotatable mechanism inside the selected radial distance of the circumferential surface.

There is further provided a centrifuge for rotating a fluid retentive housing having fluid input and output tubing fixedly connected to a rotation axis of the fluid retentive housing, the centrifuge comprising: a frame; a first rotatable mechanism having a rotation axis, the fluid retentive housing being coaxially mounted thereon for co-rotation therewith; a second rotatable mechanism having a rotation axis, the first and second rotation mechanisms being coaxially mounted on the frame for co-rotation around a common axis; the second rotatable mechanism having a radially outer circumferential surface drivably engaged with a drive mechanism for rotating the second rotatable mechanism around the common axis, the outer circumferential surface having a selected radius; wherein the tubing which is fixedly connected to the axis of the mounted fluid retentive housing has a distal length which extends axially outwardly from the fluid retentive housing; wherein the distal length of tubing is curved axially backwardly toward and extends through the second rotatable housing, the backwardly curved distal length of tubing being mounted in a seat which is mounted on the second rotatable mechanism; the seat being mounted at a radial distance from the common axis which is less than the radius of the outer circumferential surface which is drivably engaged with the drive mechanism.

The first rotatable mechanism and the fluid retentive housing typically have second and third radii respectively, the seat for the tubing being mounted on the second rotatable mechanism a radial distance from the common axis greater than the second and third radii. The first and second rotatable mechanisms typically have first and second axial thicknesses respectively, the first and second rotatable mechanisms being mounted concentrically along the common axis such that the combined axial thicknesses of the first and second rotatable mechanisms along the common axis is less than about 15 inches.

The seat preferably comprises a freely rotatable bearing having a rotation axis, the bearing being mounted on the second rotatable mechanism such that the axis of the bearing is substantially parallel to the common rotation axis.

DETAILED DESCRIPTION

Figure 1:
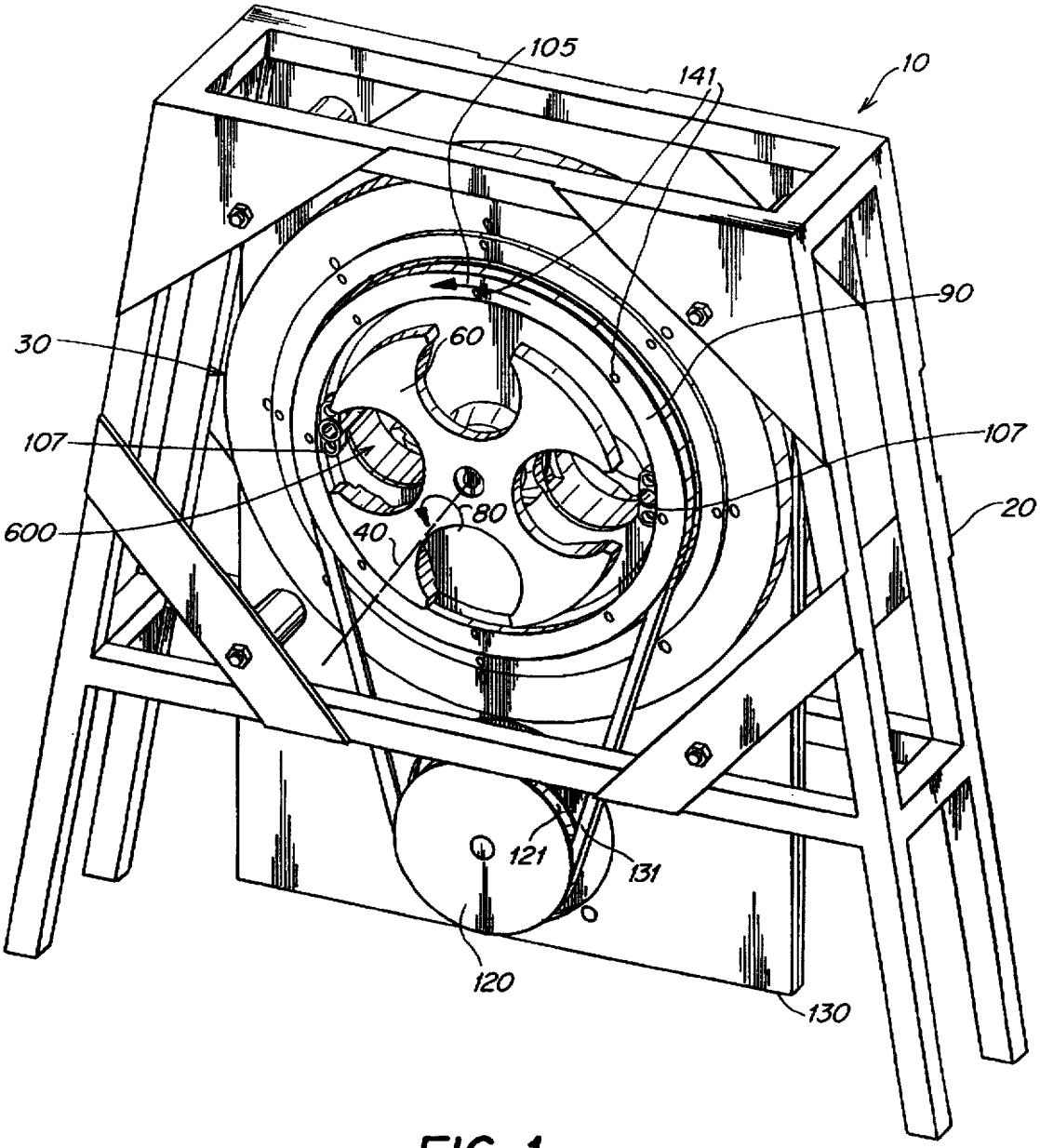
FIG. 1 is a perspective view of a centrifuge apparatus according to the invention showing its horizontal mounting on a frame.

FIG. 1 shows a fully assembled centrifuge apparatus 10 comprising a frame 20 on which is mounted a subassembly of concentrically rotating components 30. As shown in FIG. 1, a common rotation axis 40 is disposed horizontally relative to the ground.

Figure 2:
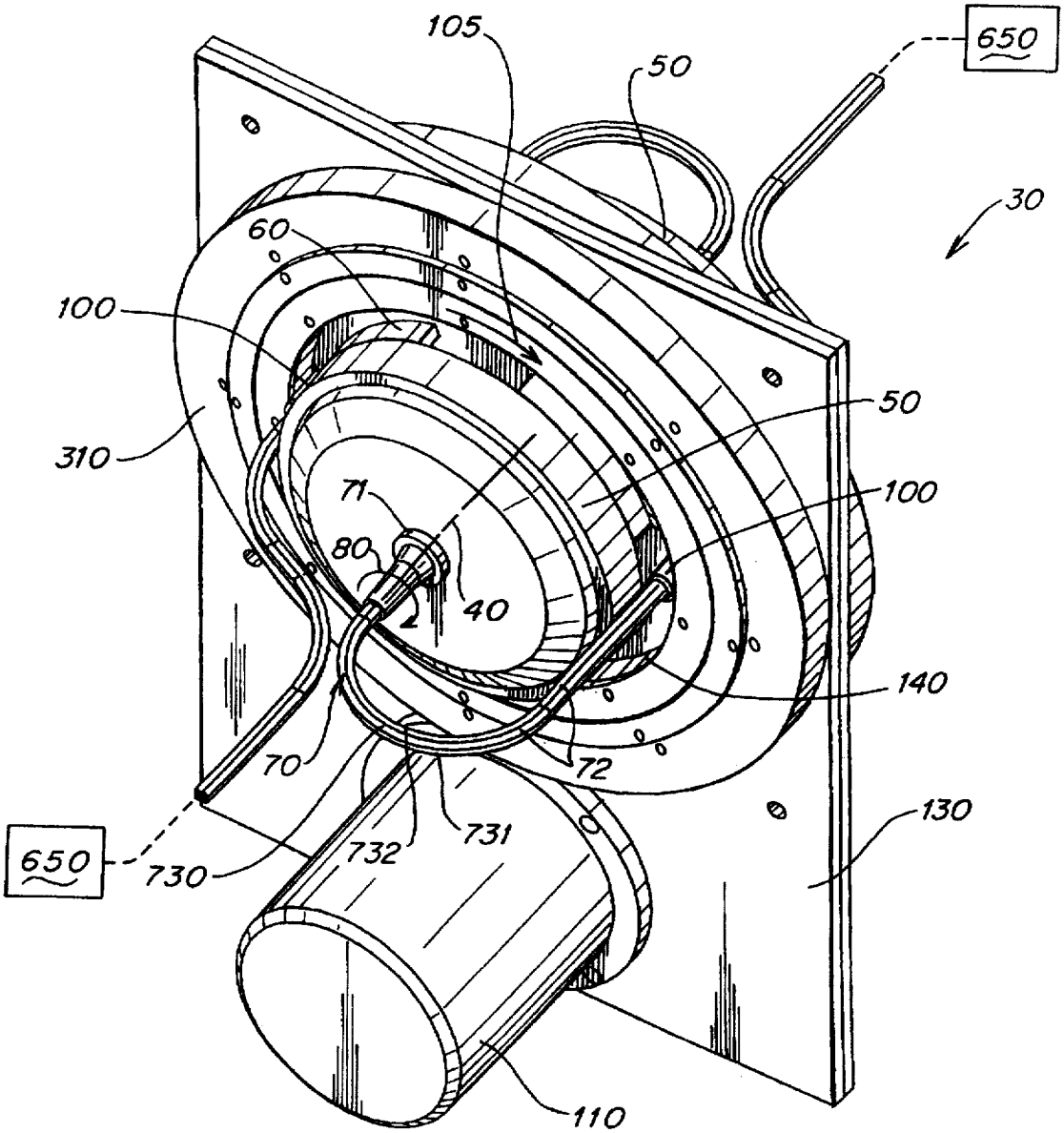
FIG. 2 is a perspective view of certain subassembled components of the FIG. 1 apparatus showing a pair of fluid retentive cassettes mounted on opposing sides of an inner rotating chuck.
Figure 5:
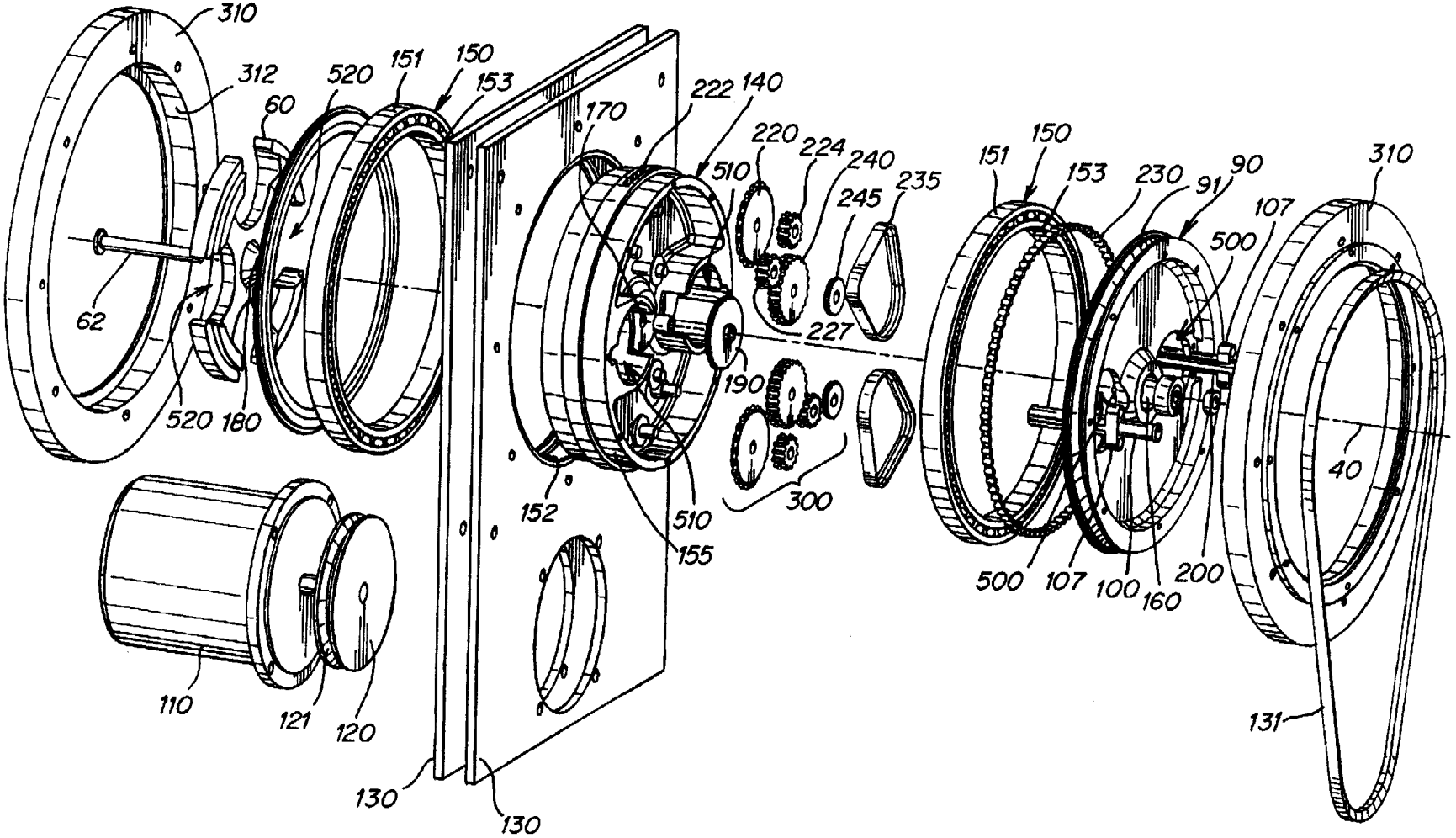
FIG. 5 is an exploded view of the FIG. 1 apparatus.

FIG. 2 shows the mounted subassembly 30 apart from the frame 20, with a pair of self-contained fluid retentive centrifuge cassettes or rotors 50 mounted on an inner rotatable chuck 60, FIG. 1. Each of the self-contained cassettes 50 have fluid input and output tubing 70 coaxially and fixedly attached to the axis 40 of the cylindrical cassettes 50. As shown, the cassettes 50 are mounted on the chuck 60 such that their rotation axes are coaxial along common axis 40. Thus, as the chucks 60 rotate 80, the fixedly attached tubing 70 co-rotates therewith. As shown, the lengths 72 of the tubing 70 which extend axially outwardly from the area of fixed attachment 71 are curved axially backwardly toward and extend through a radially outer, separately rotatable pulley 90 which as described more fully below, rotates, by virtue of a gear train interconnecting the pulley 90 and chucks 60 at a speed 105 of X rpm while the chucks rotate at a speed 80 of 2X rpm. As shown, the backwardly curved around lengths 72 of the tubing are mounted in and extend through complementary receiving bearings 100 shown more fully in FIG. 5 in exploded view. As shown in FIG. 5, the receiving bearings 100 are freely rotatably mounted within complementary apertures of mounting brackets 107 which are fixedly attached to pulleys 90. Thus, as pulleys 90 rotate 105, the backwardly curved lengths 72 of the tubing are rotated around axis 40 at a rate of X rpm while the fixedly attached end 71 of the tubing 70 is axially rotated at a rate of 2X rpm. This phenomenon is well known in the art as enabling the tubing 70 to avoid twisting around its axis even as the cassette 50 and chuck 60 force the tubing 70, 71 to be axially rotated. A fuller description of this phenomenon is described in U.S. Pat. Nos. Re.29,738 (3,586,413) (Adams). Because the bearings 100 are freely rotatable within mounting brackets 107, the rotation 105 of pulley 90 does not force the tubing to rotate around the axis of the tubing because the extension of tubing 72 is rotated together with pulley 90 around the attached end 71.

Figure 8:
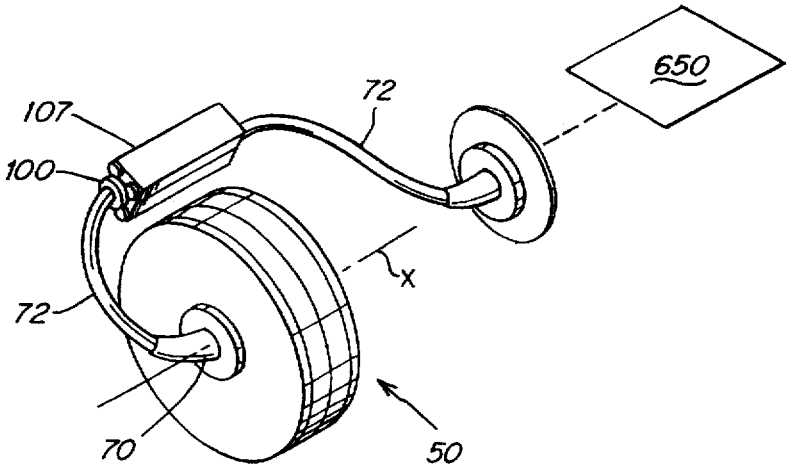
FIG. 8 is a perspective view of a fluid retentive cassette with attached tubing arranged in a configuration according to its usage on a centrifuge apparatus.
Figure 9:
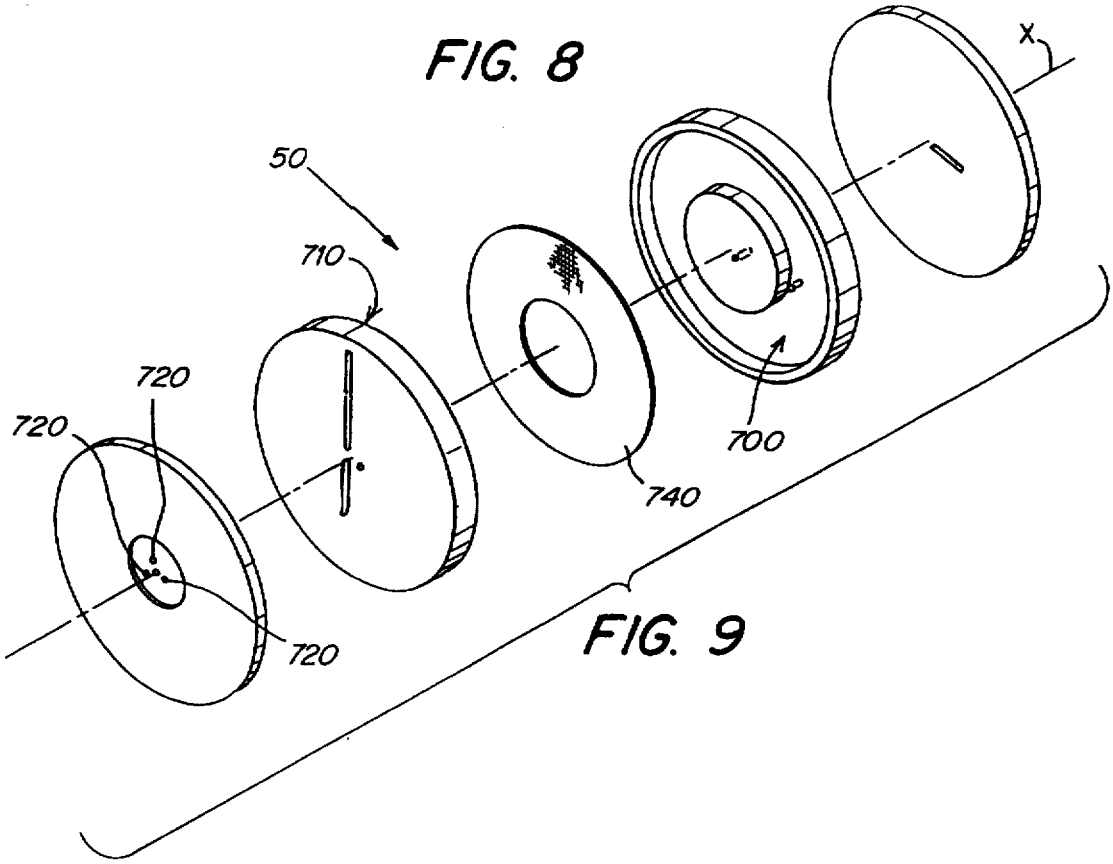
FIG. 9 is an exploded view of the FIG. 8 cassette.

The fluid retentive cassettes or rotors 50, FIG. 2, are preferably of the same or similar type as described and claimed in U.S. Pat. No. 5,431,814, the disclosure of which is incorporated herein by reference. Typically, the cassette or rotor 50 comprises a fluid sealed housing 50, FIGS. 8, 9, having two or more fluid retentive chambers 700, 710 formed within the housing wherein each chamber communicates with one or more fluid input or fluid output ports/lines 720 which are each separately connected to a separate fluid flow tube, 730, 731,732, FIG. 2. The plurality of fluid flow tubes connected to the various fluid flow ports/lines of the cassette collectively comprise the tubing 70, FIG. 2, which is fixedly connected along its axis coaxially 40 to the cassette 50. Most preferably, a cassette or rotor 50 comprises a housing having a selected axis of rotation, X, FIG. 8, the housing being rotatably mounted on a rotation mechanism 60 which rotates the housing about the selected axis of rotation of the housing; the housing sealably enclosing and defining a fluid sealed cavity extending radially outwardly from the axis of the housing; a filter 740 mounted within the cavity of the housing such that the cavity is divided into at least a first fluid retentive input chamber 700 and a second fluid retentive output chamber 710, the input and output chambers being disposed on opposite sides of the filter; a fluid input line sealably communicating with the fluid input chamber for feeding the material suspended in the fluid into the input chamber 700 under a selected pressure; the filter 740 being selectively permeable to the fluid under the selected pressure and selectively impermeable to the selected material under the selected pressure, the fluid being fed into the input chamber flowing through the filter and into the output chamber 710 under the selected pressure; a fluid output line sealably communicating with the input chamber for receiving and routing fluid which is fed into the input chamber out of the input-chamber; the rotation mechanism 60 rotating the housing around the axis such that the material suspended in the fluid in the input chamber is forced to travel under centrifugal force in a radially outward direction from the axis.

As shown in FIGS. 1, 3, 4, 5, a drive motor 110 having a driven pulley 120 is mounted in mounting plates 130 such that a drive belt 131 is tautly engageable within a circumferential groove 121 of pulley 120 and within a circumferential groove 91 within the radially outer pulley 90.

Figure 7:
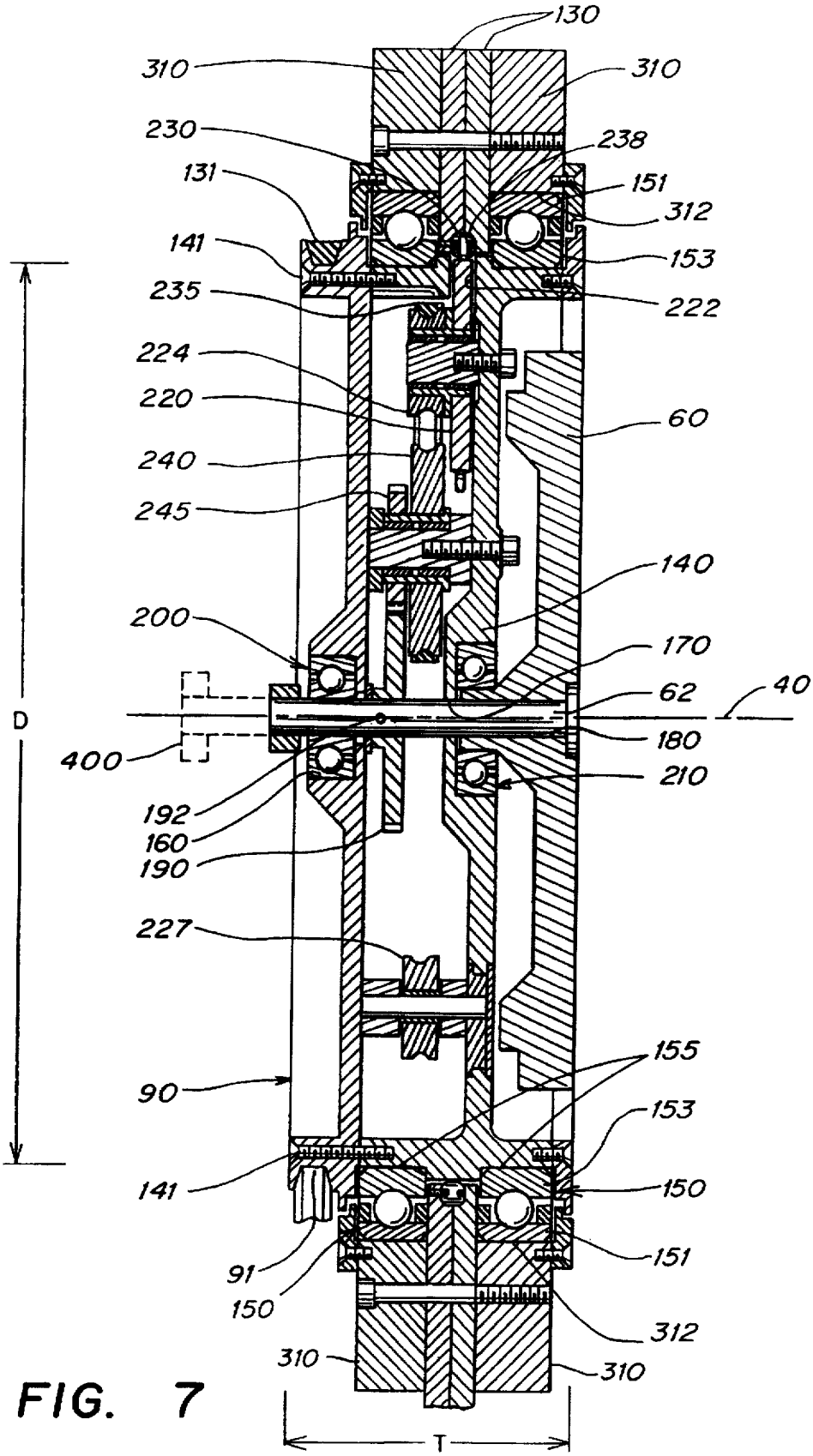
FIG. 7 is a side cross-sectional view of certain subassembled components of the FIG. 1 apparatus including an outer drive pulley and platform and an inner concentrically driven axle and chuck.

As shown in FIG. 2, the mounting of the apparatus such that the rotation axis 40 is horizontally disposed, enables two cassettes 50 to be mounted on two chucks 60 on opposing sides/faces of mounting plates 130 although in FIGS. 5, 7 only one chuck 60 is shown mounted on central axle 62 for purposes of ease of illustration.

As shown in FIGS. 5, 7 the rotating components of the apparatus are mounted on plates 130. A first radially outer rotatable mechanism comprises a pulley 90 which is fixedly connected to a drive platform via bolts 141. The pulley 90 and platform 140 rotate together around axis 40 via circumferential drive engagement of belt 131 within groove 91. The outer race 151 of bearing 150 are seated against the circumferential surfaces 152 of a mounting apertures provided in plates 130. The inner races 153 of bearings 150 are seated against the outside circumferential surfaces 155 of platform 140.

A central axle 62 extends through all of an axial rotation aperture 160 in pulley 90, an axial rotation aperture 170 in platform 140, an axial rotation aperture 180 in chuck 60 and an axial rotation aperture in innermost drive gear 190 as shown in FIGS. 5, 7. The innermost gear 190 is fixedly attached to the axle 62 via a screw 192. The chuck 60 is press-fit, i.e. fixedly friction engaged, an axle 62, such that the chuck 60 co-rotates with the axle 62 as the axle is rotatably driven by gear 192. As shown in FIGS. 5, 7, the axle 62 mounted against pulley 90 and platform 140 by virtue of bearings 200 and 210 respectively which enable the axle 62 and its associated press-fit chuck 60 to rotate at a different rate relative to pulley 90 and platform 140.

Figure 3:
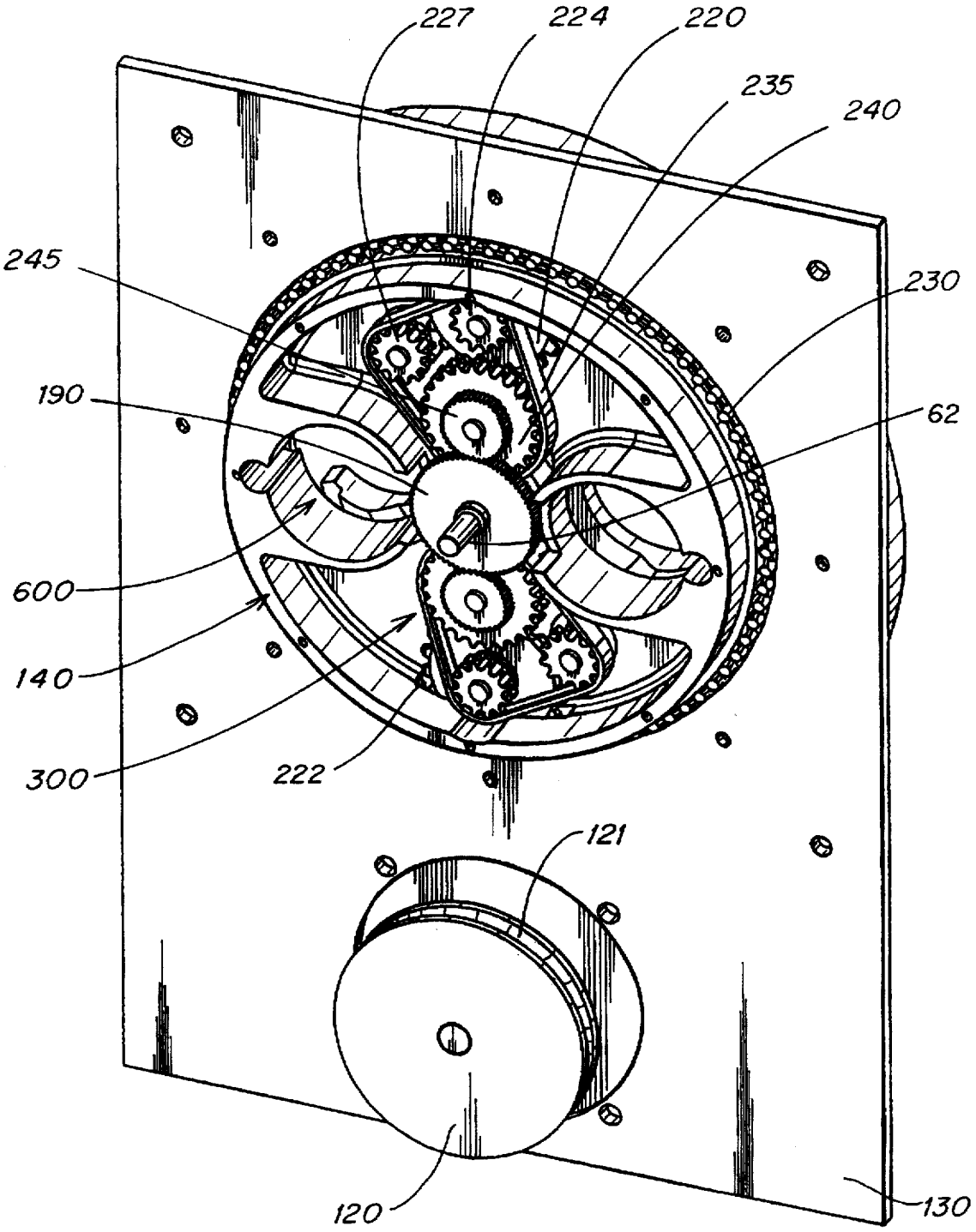
FIG. 3 is a perspective view of certain subassembled components of the FIG. 1 apparatus showing a gear train interconnection between an outer circumferentially driven rotating platform and a concentric axle which concentrically drives a rotating chuck.
Figure 4:
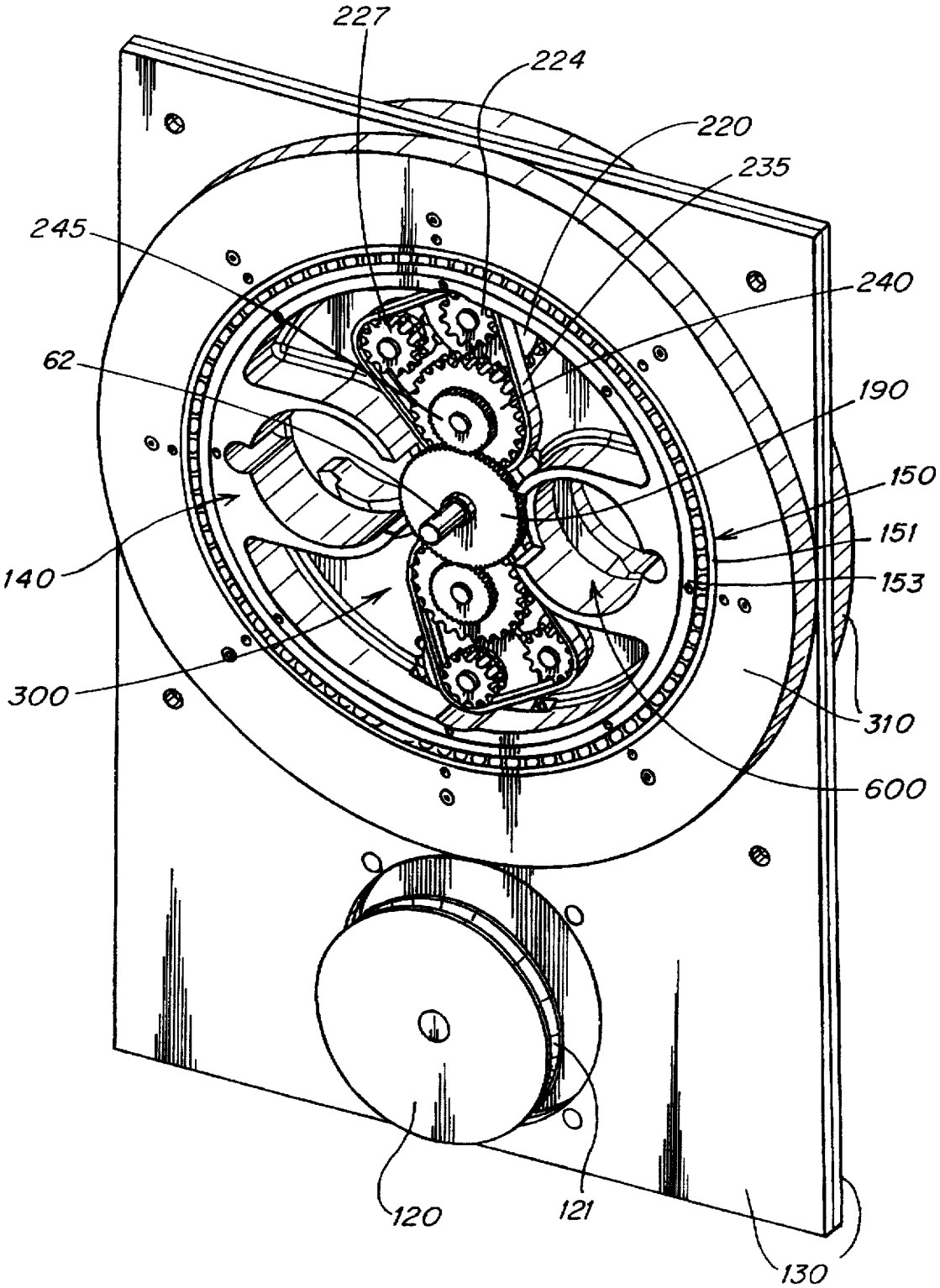
FIG. 4 is a perspective view of certain subassembled components of the FIG. 1 apparatus showing the relationship between an outer circumferentially driven pulley and the drive motor and concentrically interconnected rotatable axle which drives the chuck components of the apparatus.

As described above, pulley 90 and its associated platform 140 are rotatably driven by driven belt 131. As platform 140 rotates, an outermost gear 220 engages a complementary chain 230 through an aperture 222. The gear 220 thus rotates as platform 140 rotates. Another gear 224 which is axially fixed to gear 220 co-rotates with gear 220. Gear 224 is connected via belt 235 to gear 240 and thus driven by the rotation of gear 220. Another gear 245 which is axially fixed to gear 240 co-rotates with gear 240. Gear 245 is engaged with innermost gear 190 as shown in FIGS. 4, 7. The gear ratios of all of gears 220, 224, 240, 245 and 190 are pre-selected such that as pulley 90 and platform 140 makes one rotation around axis 40, the axle 62 makes two rotations around axis 40. As shown in FIGS. 3, 4, 5, a mirror image set of gears 300 which are identical to gears 190, 220, 224, 240, 245 are preferably mounted on platform 140.

Figure 6:
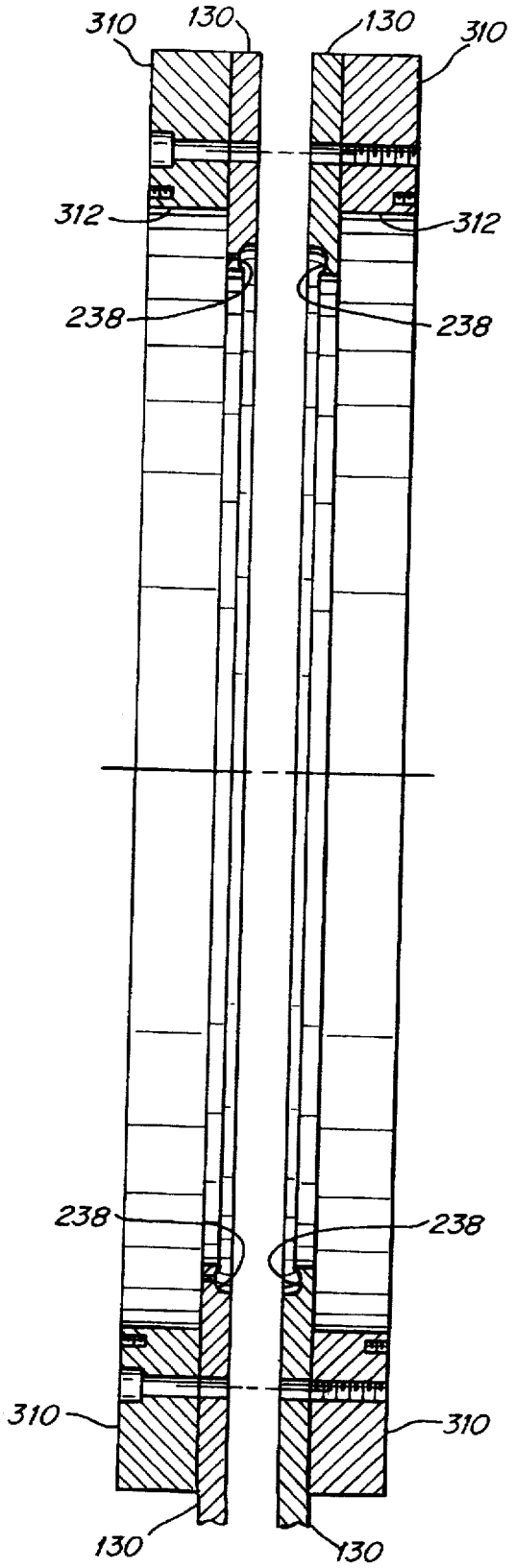
FIG. 6 is a side cross-sectional view of the mounting plate components of the FIG. 1 apparatus showing the plates separated from each other prior to assembly and showing a circumferential recess in which a chain is mounted for transmitting circumferential rotational drive to a concentric axle via a gear train.

The radially outer chain 230 is mounted in a circumferential recess 238, FIG. 6, which is drilled or lathed into one surface of each of the mounting plates 130. As shown in FIG. 6, the two plates 130 are spaced apart and when assembled/fastened together form an enclosed circumferential groove by the mating of grooves 238 into which the chain 230 has been inserted before the plates are assembled. When the plates 130 are assembled together, the chain 230 resides stationarily within the grooves 238. As described above, the outermost gear 220 is rotatably mounted on the platform 140 such that the teeth of gear 220 extend through aperture 222 and engage between the links of chain 230. Thus, as platform 140 rotates around axis 40, the gear 220 is forced to rotate and gears 224, 240, 245 and 190 are similarly forced to rotate.

In the embodiment shown, a pair of opposing mounting rings 310, FIGS. 6, 7 are fastened to the outside faces of plates 130. The mounting rings 310 provide a complementary inner circumferential surface 312 against which the outer circumferential surfaces of races 151, FIGS. 6, 7 are seatably engaged, the rings thus acting as a mount for platform 140.

As shown in FIGS. 1, 5, 7, the circumferential groove 91 of pulley 90 has a diameter D, inside of which, the bearings 100 which receive tubing extensions 72 are mounted. The groove 91 thus provides a radially outer circumferential surface by which the entire apparatus may be driven concentrically, i.e. the radially inner rotating elements such as chuck 60 are collapsed in their axial thickness (the extent of their axial extension along the length of the common axis 40) to within a relatively small thickness T, FIG. 7, which includes the axial thickness of the radially outer rotating elements, pulley 90, platform 140 and their associated components. Preferably, the total axial thickness T is less than about 15 inches, most preferably, less than about 10 inches. Thus, the overall apparatus is compact and the independently rotating elements are concentrically collapsed within and along a relatively short length of a common rotation axis thus providing for the use of two mounting surfaces for two fluid retentive cassettes on opposing ends of the axle 62 as shown for example in FIG. 2. As shown in FIG. 7, a second chuck 400 for mounting a cassette may be mounted on an extended axle (shown in dashed line) thus doubling the centrifuge capacity of the apparatus.

As shown in FIGS. 1, 3, 4, 5 the pulley 90 and platform 140 are provided with apertures 500,510, FIG. 5 and the chuck 60 is configured with recesses 520 which are aligned with each other upon assembly to form a completely open passage 600 from one face of the apparatus to the opposite face. The passage 600 enables the user to utilize fully assembled pre-sterilized fluid bags/packages in conjunction with the apparatus. That is, in many uses of centrifuges the fluid to be centrifuged comprises a pre-packaged, pre-sterilized bag on package of fluid connected to one or more tubes. The connection between the tubing and the bag or package cannot be broken without compromising the sterility of the fluid. Thus, in attaching the free end of the tubing to the axis of a cassette or rotor which is mounted on the chuck 60 of the apparatus 10, FIG. 1, the extension of the tubing 72 cannot be properly mounted in the bearings 100 without disconnecting the tubing from the bag or package of fluid 650 shown in schematic in FIG. 2. The passages 600, FIGS. 1, 3, 4 allow the user to connect such pre-assembled, pre-sterilized packages of fluid to a cassette 50 without disconnection of the tubing 72 from the bag 650 by simply allowing the user to route the bag 650 through the passages 600 after the cassette 50 is mounted on a chuck 60.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

What is claims is:

1. A centrifuge for rotating a fluid retentive housing having fluid input and output tubing fixedly connected to a rotation axis of the fluid retentive housing, the centrifuge comprising:

a frame;

a first rotatable mechanism having a rotation axis and a first diameter, the fluid retentive housing being coaxially mounted on the first rotatable mechanism for co-rotation therewith;

a second rotatable mechanism having a rotation axis and a second diameter greater than the first diameter, the first and second rotatable mechanisms being coaxially mounted on the frame;

the second rotatable mechanism having an outer circumferential surface engaged with a drive mechanism, the drive mechanism driving the outer circumferential surface such that the second rotatable mechanism rotates at a selected rotational speed X;

the first rotatable mechanism being interconnected to the second rotatable mechanism such that the first rotatable mechanism rotates simultaneously with the second rotatable mechanism at a rotational speed of 2X.

2. The centrifuge of claim 1 wherein the second rotatable mechanism includes a seat for holding a distal length of the output tubing which extends from the axis of the fluid retentive housing, wherein the distal length of the output tubing held by the seat is rotated around the rotation axis at the same rotational speed as the second rotatable mechanism.

3. The centrifuge of claim 2 wherein the outer circumferential surface which engages the drive mechanism is spaced a selected radial distance from the rotation axis, the seat being mounted on the second rotatable mechanism inside the selected radial distance of the circumferential surface.

4. The centrifuge of claim 1 wherein the first and second rotatable mechanisms are mounted such that their axes of rotation are disposed horizontally.

5. The centrifuge of claim 1 wherein the first rotatable mechanism has opposing mounting faces for mounting a fluid retentive housing on each of the opposing mounting faces.

6. A centrifuge for rotating a fluid retentive housing such that one or more selected materials suspended in a fluid retained within the housing are centrifuged upon rotation of the housing, the centrifuge comprising:

a frame;

a first wheel mechanism having a first diameter; and a second wheel mechanism having a second diameter greater than the first diameter;

the first and second wheel mechanisms being concentrically mounted on the frame for simultaneous co-rotation around a common axis;

the second wheel mechanism being circumferentially driven such that the second wheel mechanism rotates at a rotational speed X around the common axis;

the first wheel mechanism being interconnected to the second wheel mechanism such that the first wheel mechanism rotates at a rotational speed of 2X around the common axis upon circumferential driving of the second wheel mechanism;

the fluid retentive housing being mounted on the first wheel mechanism for co-rotation therewith.

7. The centrifuge of claim 6 wherein the fluid retentive housing is fixedly connected at an axis of the housing to an end of a flexible fluid delivery tubing, wherein the tubing extends outwardly from its fixedly connected end and is mounted along a distal length of the tubing in a seat which is mounted on the second wheel mechanism outside the diameter of the first wheel mechanism.

8. The centrifuge of claim 6 wherein the first and second wheel mechanisms are each mounted such that the common axis of rotation is disposed horizontally.

9. The centrifuge of claim 6 wherein the first wheel mechanism has opposing mounting faces for mounting a fluid retentive housing on each of the opposing mounting faces.

10. A centrifuge for rotating a fluid retentive housing having fluid input and output tubing fixedly connected to a rotation axis of the fluid retentive housing, the centrifuge comprising:

a frame;

a first rotatable mechanism having a rotation axis, the fluid retentive housing being coaxially mounted on the first rotatable mechanism for co-rotation therewith;

a second rotatable mechanism having a rotation axis, the first and second rotatable mechanisms being coaxially mounted on the frame for co-rotation around a common axis;

the second rotatable mechanism having a radially outer circumferential surface drivably engaged with a drive mechanism for rotating the second rotatable mechanism around the common axis, the outer circumferential surface having a selected radius;

wherein the tubing which is fixedly connected to the axis of the mounted fluid retentive housing has a distal length which extends axially outwardly from the fluid retentive housing;

wherein the distal length of tubing is curved axially backwardly toward and extends through the second rotatable mechanism, the backwardly curved distal length of tubing being mounted in a seat which is mounted on the second rotatable mechanism;

the seat being mounted at a radial distance from the common axis which is less than the radius of the outer circumferential surface which is drivably engaged with the drive mechanism.

11. The centrifuge of claim 10 wherein the first and second rotatable mechanisms are interconnected such that the first rotatable mechanism is rotatably driven by rotation of the second rotatable mechanism.

12. The centrifuge of claim 10 wherein the first rotatable mechanism and the fluid retentive housing have second and third radii respectively, the seat for the tubing being mounted on the second rotatable mechanism a radial distance from the common axis greater than the second and third radii.

13. The centrifuge of claim 10 wherein the first and second rotatable mechanisms have first and second axial thicknesses respectively, the first and second rotatable mechanisms being mounted concentrically along the common axis such that the combined axial thicknesses of the first and second rotatable mechanisms along the common axis is less than about 15 inches.

14. The centrifuge of claim 10 wherein the common axis is disposed horizontally.

15. The centrifuge of claim 10 wherein the seat comprises a freely rotatable bearing having a rotation axis, the bearing being mounted on the second rotatable mechanism such that the axis of the bearing is substantially parallel to the common rotation axis.

16. A centrifuge for rotating first and second fluid retentive housings each having fluid input and output tubing fixedly connected to a rotation axis of the fluid retentive housings, the centrifuge comprising:

a frame;

a first rotatable mechanism having a rotation axis, the first and second fluid retentive housings being coaxially mounted on opposing mounting surfaces disposed on the first rotatable mechanism for co-rotation therewith;

a second rotatable mechanism having a rotation axis, the first and second rotatable mechanisms being coaxially mounted on the frame;

the second rotatable mechanism having an outer circumferential surface engaged with a drive mechanism, the drive mechanism driving the outer circumferential surface such that the second rotatable mechanism rotates at a selected rotational speed X;

the first rotatable mechanism being interconnected to the second rotatable mechanism such that the first rotatable mechanism rotates simultaneously with the second rotatable mechanism at a rotational speed of 2X.

17. The centrifuge of claim 16 wherein the second rotatable mechanism includes a seat for holding a distal length of the output tubing which extends from the axis of a fluid retentive housing, wherein the distal length of the output tubing held by the seat is rotated around the rotation axis at the same rotational speed as the second rotatable mechanism.

18. The centrifuge of claim 17 wherein the seat comprises a bearing having a rotation axis substantially parallel to the rotation axis of the rotatable mechanisms.

19. The centrifuge of claim 17 wherein the outer circumferential surface which engages the drive mechanism is spaced a selected radial distance from the rotation axis, the seat being mounted on the second rotatable mechanism inside the selected radial distance of the circumferential surface.

20. The centrifuge of claim 16 wherein the first and second rotatable mechanisms are mounted such that their axes of rotation are disposed horizontally.

* * * * *